US008867967B2

(12) United States Patent
Yamauchi et al.

(10) Patent No.: US 8,867,967 B2
(45) Date of Patent: Oct. 21, 2014

(54) DEVELOPMENT APPARATUS

(75) Inventors: Satoru Stephen Yamauchi, Tokyo (JP); Takanori Iida, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 185 days.

(21) Appl. No.: 13/353,581

(22) Filed: Jan. 19, 2012

(65) Prior Publication Data

US 2012/0189352 A1 Jul. 26, 2012

(30) Foreign Application Priority Data

Jan. 26, 2011 (JP) ..... 2011-013975
Jul. 12, 2011 (JP) ..... 2011-153782

(51) Int. Cl.
*G03G 15/08* (2006.01)

(52) U.S. Cl.
CPC ..... *G03G 15/0893* (2013.01)
USPC ..... 399/258; 399/256

(58) Field of Classification Search
CPC ..... G03G 15/0893
USPC ..... 399/254, 256, 258
See application file for complete search history.

(56) References Cited

U.S. PATENT DOCUMENTS

| | | | | |
|---|---|---|---|---|
| 7,925,188 | B2 * | 4/2011 | Senoh et al. | 399/255 |
| 2009/0136257 | A1 * | 5/2009 | Hattori et al. | 399/111 |
| 2011/0158665 | A1 | 6/2011 | Yamauchi | |

FOREIGN PATENT DOCUMENTS

| | | | |
|---|---|---|---|
| JP | 59-100471 | A | 6/1984 |
| JP | 10-186855 | A | 7/1998 |
| JP | 11-84874 | A | 3/1999 |
| JP | 2003-167438 | A | 6/2003 |
| JP | 2006-250973 | A | 9/2006 |
| JP | 2010-164868 | A | 7/2010 |
| JP | 2010-204506 | A | 9/2010 |

* cited by examiner

*Primary Examiner* — David Gray
*Assistant Examiner* — Michael Harrison
(74) *Attorney, Agent, or Firm* — Fitzpatrick, Cella, Harper & Scinto

(57) ABSTRACT

A development apparatus includes a developer bearing member which develops a latent image, a first room supplying developer to the developer bearing member, and a second room connecting to the first room via opening portions formed at both ends of the first room, with the first room and the second room forming a circulation passage circulating the developer. In addition, a partition wall partitions the first room and the second room, a replenishment passage connects outside of the circulation passage and replenishes the developer, and a discharge port discharges surplus developer from the development container. A replenishing screw is arranged in the replenishment passage and conveys developer in a replenishing port toward the circulation passage, and a ventilation port is formed at a replenishing port side outside of the circulation passage of the first room or the second room or inside of the replenishment passage.

4 Claims, 15 Drawing Sheets

DEVELOPMENT APPARATUS

BACKGROUND OF THE INVENTION

1. Field of the Invention

The present invention relates to a development apparatus used for an image forming apparatus such as a copying machine and a printer utilizing an electrophotographic system.

2. Description of the Related Art

There has been a magnetic brush development method to perform development utilizing two-component developer as a development apparatus utilized for a conventional image forming apparatus such as a copying machine, a printer and a facsimile machine.

In the magnetic brush development method, only toner particles are consumed for image forming and carrier particles are to be worn as circulating in a development apparatus. Therefore, such a development apparatus is provided with a mechanism to replenish replenisher obtained by mixing toner and carrier at a predetermined ratio as discharging a part of developer according to operation of the development apparatus. Accordingly, it is possible to suppress the wear degree of the carrier staying in the development apparatus within a certain range while replenishing toner consumed according to image forming.

With such a mechanism of replenishing and discharging developer (i.e., an auto carrier refreshing mechanism (ACR)), replenishment is normally performed as follows. That is, a mixture ratio between the toner and carrier is detected by a toner concentration sensor which is disposed in the development apparatus and the replenishment amount is adjusted so that the detection result becomes a desired mixing ratio. Since a toner mixing ratio of replenisher is larger than a toner mixing ratio of developer in the development apparatus in normal cases, the toner mixing ratio in the development apparatus is increased with replenishment.

Meanwhile, as disclosed in Japanese Patent Laid-open No. 59-100471, in view of mechanism simplification, it is popular to adopt a method for discharging to simply form a hole (i.e., a discharge hole) at a predetermined position in a development apparatus and to make developer of which bulk is increased with replenishment overflow therefrom. When bulk density of the developer is constant, the present mechanism has a function to define the upper limit of the developer amount in the development apparatus. Meanwhile, provided that the developer is sufficiently agitated, the toner mixing ratio is not varied. Accordingly, behavior thereof is easily assumed.

In Japanese Patent Laid-open No. 10-186855, a discharge port is formed at a position adjacent to a replenishing port for replenishing replenisher at the upstream side in a developer conveyance direction. With this structure, replenisher is prevented from being discharged through the discharge port in a state of having an unstable toner mixing ratio without being sufficiently agitated.

It is preferable that the total developer amount staying in the development apparatus as disclosed in Japanese Patent Laid-open No. 59-100471 and Japanese Patent Laid-open No. 10-186855 is constant or at least in a predetermined range. An excessive amount of developer causes overflowing from the development apparatus according to variation of developer flowability. On the other hand, when the developer amount is too low, a sufficient amount of the developer is not supplied to an entire imaging area of a development sleeve to cause missing of an output image in part. Accordingly, it is ideal that discharging is not performed at all until the developer amount reaches a certain level and only an amount of developer exceeding a threshold value is promptly discharged when the developer amount exceeds the threshold value.

However, in actual fact, there is a case that a developer discharge amount cannot be controlled appropriately with variation of bulk density and flowability of developer due to developer wear and variation of ambient temperature and humidity. Further, when air pressure in a development apparatus becomes negative against outside pressure, airflow to draw air at the vicinity of a discharge port to the inside of the development apparatus occurs and developer becomes difficult to be discharged.

Here, positional relation between the discharge port and the replenishing port of toner in the development apparatus is arranged so that discharging is performed while replenished toner is sufficiently agitated. The replenisher replenished from the replenishing port is conveyed to a developer circulation passage by a conveying unit disposed outside the developer circulation passage before being merged to the developer circulation passage in the development apparatus. That is, there is a conveying unit disposed to convey only replenisher which in not mixed yet to the developer circulating in the development apparatus.

In such a system, when the replenishing port is hermetically-closed, air at the vicinity of the replenishing port is sucked by the above-mentioned conveying unit and negative pressure is generated at the vicinity of a merging point with the developer circulation passage. On the contrary, when the replenishing port is opened, the above phenomenon does not occur. In this manner, air pressure in the development apparatus depends on airtightness at the replenishing port.

When the pressure at the vicinity of the merging point with the developer circulation passage becomes negative, developer existing at the upstream side thereof is drawn toward the downstream side. Normally, the discharge port is located at the upstream side of the replenishing port to prevent replenisher from being discharged without being agitated. Accordingly, in a case with negative pressure, the developer existing at the vicinity of the discharge port is drawn and developer discharging is disturbed.

In this manner, easiness of developer discharging is varied according to airtightness at the replenishing port. Therefore, the airtightness at the replenishing port is required to be kept constant to stabilize the developer amount in the development apparatus. Normally, the replenishing port is appropriately closed to prevent leakage of replenisher from a gap. However, on the other hand, it is difficult to maintain complete airtightness with a detachable development apparatus. The degree of airtightness at the replenishing port is varied according to slight variation of an attaching position of the development apparatus. The above causes variation of easiness of developer discharging and variation of the developer amount staying in the development apparatus. Then, poor imaging is caused owing to developer overflowing and developer supplying shortage.

SUMMARY OF THE INVENTION

To address the above issues, the present invention provides a development apparatus capable of suppressing instability of discharge characteristics of developer through a discharge port due to negative pressure caused at the vicinity of the developer replenishing port. The development apparatus of the present invention includes a developer bearing member which develops a latent image, a development container which supports the developer bearing member and which includes a circulation passage in which developer supplied to the developer bearing member is circulated, a discharge port through which surplus developer in the development container is discharged from the development container, a replenishing port through which developer is replenished to the development container as being arranged outside of the circulation passage, a replenishment passage which connects the replenishing port and the circulation passage, a replenishing screw which conveys developer in the replenishing port toward the circulation passage, and a ventilation port which is formed at a passage being connected to the circulation passage from the outside of the circulation passage and which is capable of ventilating the circulation passage without via the discharge port.

Further features of the present invention will become apparent from the following description of exemplary embodiments with reference to the attached drawings.

DESCRIPTION OF THE EMBODIMENTS

First Embodiment

Figure 1A:
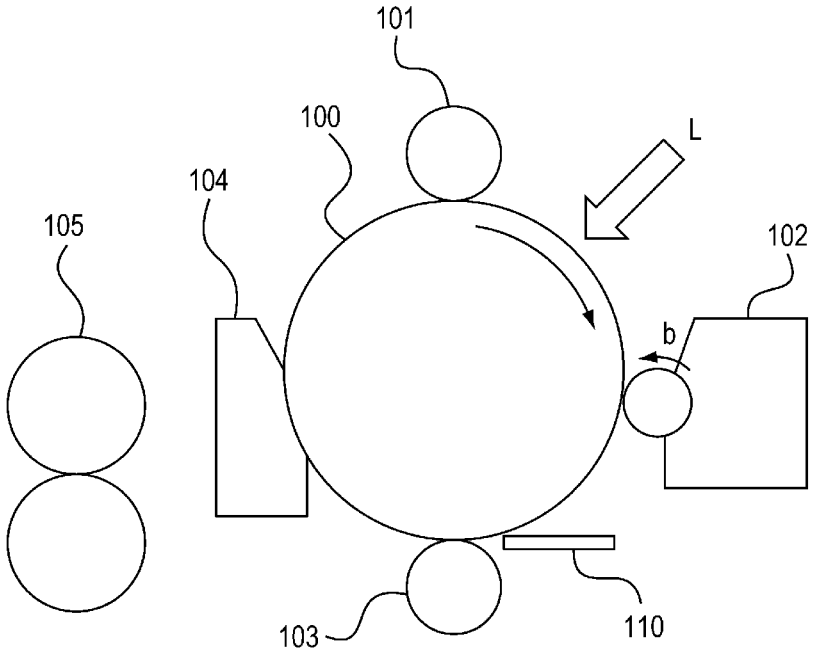
FIG. 1A is a structural view of an image forming apparatus according to a first embodiment and FIG. 1B is a structural view of a development apparatus according to the first embodiment.

A development apparatus and an image forming apparatus of the first embodiment according to the present invention will be described with reference to the drawings. FIG. 1A is a structural view of the image forming apparatus according to the present embodiment. As illustrated in FIG. 1A, in the image forming apparatus according to the present embodiment, an electrostatic latent image is formed on a surface of a photosensitive drum (i.e., an image bearing member) 100 by evenly charging the surface of the photosensitive drum 100 with a primary charger 101 and performing image exposure according to image information with a laser exposure device (not illustrated).

The formed electrostatic latent image is developed to be a toner image by a development apparatus 102 as utilizing two-component developer which includes magnetic carrier and non-magnetic toner. The developed toner image is transferred to a transfer material 110 which is conveyed to a transfer portion by a transfer roller 103. The transfer material 110 to which the toner image is transferred is discharged to the outside of an apparatus body after the toner image is fixed by the fixing device 105. Transfer-remaining toner remaining at the photosensitive drum 100 after the toner image is transferred is removed by a cleaner 104 and is used for a subsequent image forming.

(Development Apparatus 102)

Figure 1B:
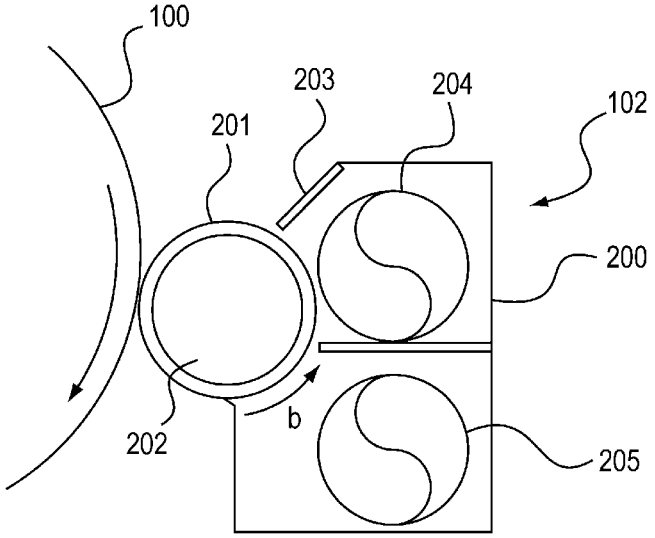
Figure 2A:
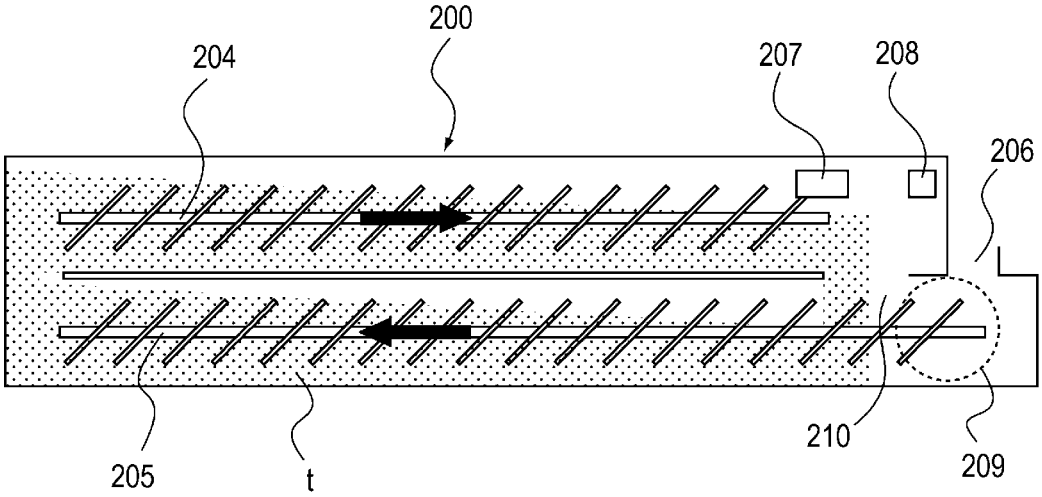
FIG. 2A is a sectional view in the longitudinal direction of the development apparatus according to the first embodiment and FIG. 2B is a diagram indicating developer flow according to the first embodiment.

As illustrated in FIGS. 1B and 2A, the development apparatus 102 includes a development container 200, a development sleeve (i.e., a developer bearing member) 201, a magnet roller (a magnetic field generating unit) 202, a restricting blade (a developer restricting unit) 203, and screws (developer conveying members) 204, 205. Further, the development apparatus 102 includes a replenishing port 206, a discharge port 207, and a ventilation hole 208.

The development container 200 accommodates two-component developer t formed of toner and carrier. The development sleeve 201 is disposed to the development container 200 at a position facing to the photosensitive drum 100 as being rotatable in the direction of arrow b. The magnet roller 202 is placed at the inside of the development sleeve 201. The development sleeve 201 is rotated as the surface thereof being along the circumference of the magnet roller 202. The restricting blade 203 is arranged so that the closest point thereof is at a position having a predetermined distance against the development sleeve 201.

The screws 204, 205 are placed at the inside of the development apparatus 102 and circulate the two-component developer t between an agitation room and a development room. The two-component developer t aligned by magnetic force of the magnetic roller 202 at the development portion is contacted to the surface of the photosensitive drum 100, and then, only the toner is transferred to an electrostatic latent image formed on the surface of the photosensitive drum 100 by development bias applied to the development sleeve 201. In this manner, a toner image is formed.

The two-component developer t remaining at the development sleeve 201 after the development passes through the development portion according to rotation of the development sleeve 201 and is removed from the surface of the development sleeve 201 as receiving magnetic repulsive force after returning into the development container 200. Then, the two-component developer t is passed to the screw 204 as being conveyed by the screw 205 which is disposed below the development sleeve 201.

Replenisher is replenished through the replenishing port 206 to compensate the toner consumed at the development process. The replenisher is a mixture of toner and carrier of which weight ratio is to be 9 to 1. The replenisher is filled in a hopper (not illustrated) which is connected to the replenishing port 206.

A mean permeability of the developer is detected by a permeability sensor (not illustrated) disposed in the development container 200 and a weight ratio of the toner in the developer is calculated from the mean permeability. The replenishment is performed when the weight ratio is below 8%. The replenishment is performed by conveying the replenisher in the hopper to the replenishing port 206 with rotation of the screw disposed in the hopper. The replenisher replenished from the replenishing port 206 is conveyed by a replenisher conveying portion 209 which has a function only to convey the replenisher in the screw 205 and is merged to a circulation passage of other developer circulating in the developer container 200. The replenisher conveying portion 209 is placed below the replenishing port 206 in the vertical direction as being outside the circulation passage of other circulating developer.

Since the replenisher includes carrier, the total amount of the developer is increased even when replenishment is performed only to compensate the consumed toner. When the powder surface of the developer is heightened and reaches the lower end of the discharge port 207, the developer is discharged to the outside of the developer container 200 through the discharge port 207. The discharge port 207 is formed above the development room at the downstream side in the direction of developer conveyance due to the screw 204 in the development room.

The developer discharged through the discharge port 207 is discarded into a waste toner box (not illustrated) via a discharge passage (not illustrated). The above structure suppresses overflowing of the developer through a gap with the development sleeve 201 caused by excessively increased developer.

(Ventilation Hole 208)

The ventilation hole 208 is formed vertically above an opening portion 210 which passes the developer from the screw 204 to the screw 205 and at the downstream side from the discharge port 207 and the opening portion 210 in the direction of developer conveyance due to the screw 204. The ventilation hole 208 is formed outside the developer circulation passage which is formed of the screws 204, 205. Accordingly, the developer does not reach the position of the ventilation hole 208 and the developer does not overflow through the ventilation hole 208. The ventilation hole 208 provides communication between the inside and outside of the developer container 200.

Figure 5:
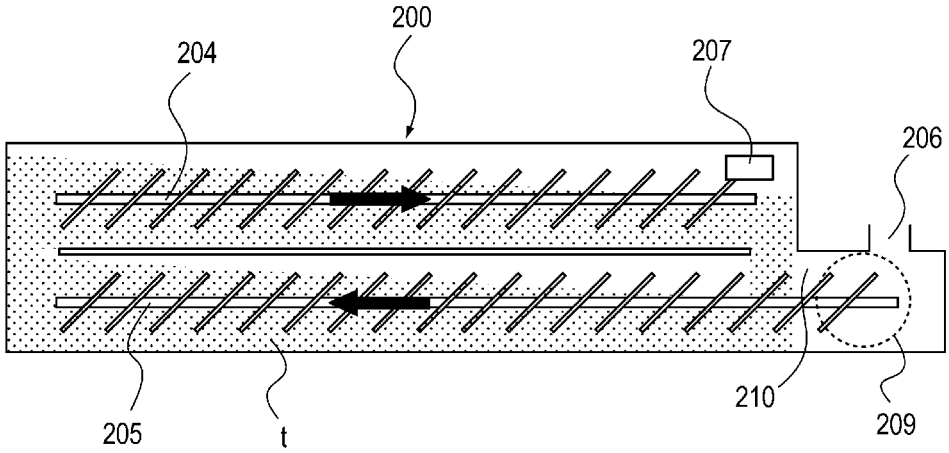
FIG. 5 PRIOR ART
FIG. 5 is a structural view of a development apparatus in the related art.

As illustrated in FIG. 5, a development apparatus in the related art does not include a ventilation hole 208. Accordingly, airtightness at a connection portion between the replenishing port 206 and the hopper (not illustrated) connected thereto becomes unstable owing to variation of an attaching position of the development apparatus. As a result, airflow is disturbed at the vicinity of the discharge port 207 to cause suction of developer to the discharge port 207.

Specifically, air around the replenisher conveying portion 209 is sucked toward the downstream side of the replenisher conveyance direction by the replenisher conveying portion 209 of the screw 205 during operation of the screw 205. Then, air around the vicinity of the discharge port 207 located at the upstream side in the developer conveyance direction is sucked in the direction orienting toward the replenisher conveying portion 209 to compensate air around the replenisher conveying portion 209 having negative pressure.

Accordingly, airflow to draw the developer to be discharged from the discharge port 207 back to the inside of the developer container 200 is generated, so that developer discharging is interfered. The interference degree depends on air pressure around the replenisher conveying portion 209 and the air pressure depends on the unstable airtightness at the vicinity of the replenishing port 206.

As illustrated in FIG. 2A, the development apparatus 102 of the present embodiment includes the ventilation hole 208 at the vicinity of the discharge port 207. When pressure at the vicinity of the replenisher conveying portion 209 becomes negative, the air to draw back from the upstream side in the developer conveyance direction for compensating the negative pressure is positively supplied from the outside of the developer container 200 through the ventilation hole 208 which is communicated with the replenishing port 206. Accordingly, although there may be a case that air-drawing from the discharge port 207 still remains, the airflow occurring at the vicinity of the discharge port 207 is reduced at least by the amount of influence of the ventilation hole 208. Consequently, instability of the developer discharge amount is remarkably improved. In this manner, the ventilation hole 208 stabilizes the developer discharge amount by smoothing the airflow at the vicinity of the discharge port 207.

Here, as can be seen from comparison between FIG. 2A and FIG. 5, the developer container 200 is expanded by the amount of space for arranging the ventilation hole 208 in the present embodiment. This is to satisfy the above-mentioned positional relation among the replenishing port 206, the discharge port 207, and the ventilation hole 208. Therefore, provided that the ventilation hole 208 is formed at a position outside the developer circulation passage as being communicated with the replenishing port 206, the developer container 200 is not necessarily to be expanded.

Figure 2B:
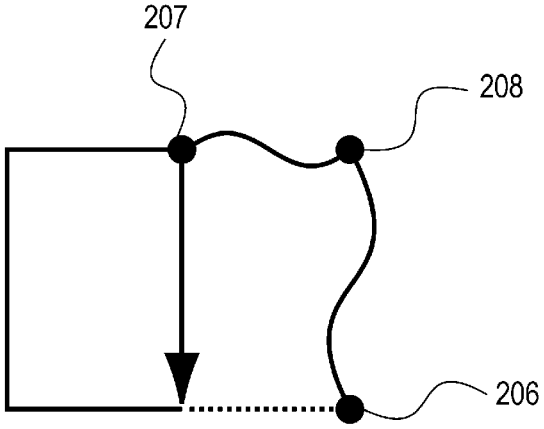

FIG. 2B is a diagram indicating developer flow in the present embodiment. In FIG. 2B, straight lines indicate passages with conveying capability and wave lines indicate communicated passages without conveying capability. Solid lines among the straight lines indicate developer circulation passages and a dotted line there among indicates a replenisher passing passage through which only the replenisher passes. Not limited to the structure of the present embodiment, the present invention may adopt a development apparatus and an image forming apparatus as long as embodying the diagram of FIG. 2B.

(Amount of Staying Developer in Development Container 200)

As described above, as a result of arranging the ventilation hole 208, the development apparatus 102 of the present embodiment maintain constant airtightness at the replenishing port 206 and maintain constant easiness of developer discharging. Accordingly, the amount of the developer staying in the development container 200 (i.e., the total developer amount) is stabilized.

The total developer amount is determined based on the developer discharge amount discharged from the discharge port 207 and the toner consumption amount used for image forming. The developer discharge amount depends on the total developer amount. The developer discharge amount per unit time becomes large with increase of the total developer amount. The toner consumption amount depends on output images.

In the present embodiment, developer replenishment is performed to compensate toner by the same amount as the toner consumption amount. Here, since carrier is included in the developer in addition to toner, the total developer amount is increased by the amount of carrier with performing replenishment. In a case that solid images are continuously output, the total developer amount is closed to the maximum value with replenishment performed at the maximum efficiency. On the other hand, in a case that white solid images are continuously output, the total developer amount is closed to the minimum value with little replenishment performed. Here, to discharge deteriorated toner, even in the case that white solid images are continuously output, toner is to be consumed at the same degree as assuming that solid images are formed in an area of which area ratio is 1% against the imaging area.

In the present embodiment, "the total developer amount in a case that the developer discharge amount per unit time is to be 0.05 g/s" provides the maximum value of the total developer amount. Further, "the total developer amount in a case that the developer discharge amount per unit time is to be 0.0005 g/s" provides the minimum value of the total developer amount.

(Experiment of Quantifying Variation of Total Developer Amount)

Figure 3:
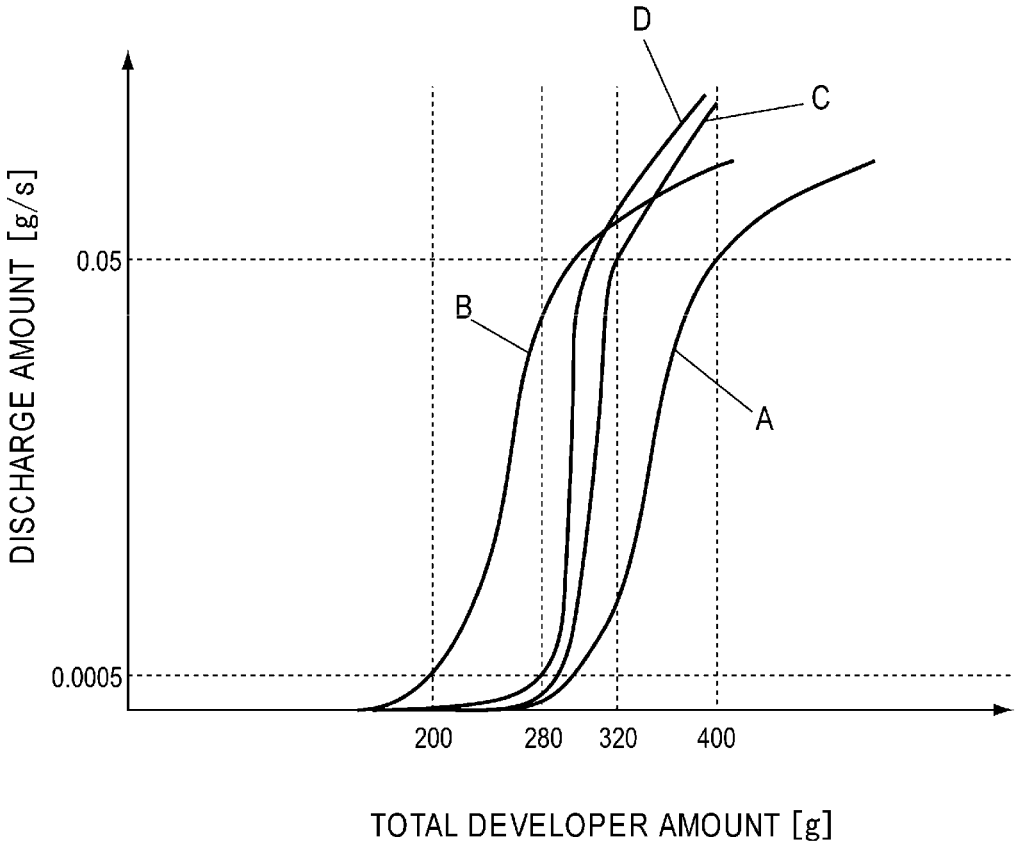
FIG. 3 is a graph indicating relation between a total developer amount and a developer discharge amount according to the first embodiment.

FIG. 3 is a graph indicating relation between the total developer amount and the developer discharge amount. In FIG. 3, line A indicates the relation when the replenishing port 206 is blocked and line B indicates the relation when the replenishing port 206 is opened in a case without the ventilation hole 208 formed as in the conventional development apparatus. Meanwhile, line C indicates the relation when the replenishing port 206 is blocked and line D indicates the relation when the replenishing port 206 is opened in a case with the ventilation hole 208 formed as in the development apparatus 102 of the present embodiment. For each of lines A to D, the horizontal axis denotes the total developer amount and the vertical axis denotes the developer discharge amount per second. The variation of the total developer amount is defined by the difference between the above-mentioned maximum value and the minimum value.

As indicated by lines A and B in FIG. 3, the relation between the total developer amount and the developer discharge amount drastically varies with airtightness at the replenishing port 206 when the ventilation hole 208 is not formed. In this case, the upper limit and the lower limit of the total developer amount are respectively 400 g and 200 g to cause variation of two times. When the total developer amount is 400 g, the developer overflows from the development container 200. On the other hand, when the total developer amount is 200 g, a missing part appears in an output image owing to developer supplying shortage.

In contrast, as indicated by lines C and D in FIG. 3, the relation remains approximately at constant regardless of airtightness of the replenishing port 206 when the ventilation hole 208 is formed. In this case, the upper limit and the lower limit of the total developer amount are 320 g and 280 g respectively. That is, the total developer amount can be stabilized as the variation range of the total developer amount being between 280 g and 320 g by forming the ventilation hole 208. Accordingly, it is possible to avoid poor imaging due to developer overflow and developer supplying shortage.

Second Embodiment

Figure 4:
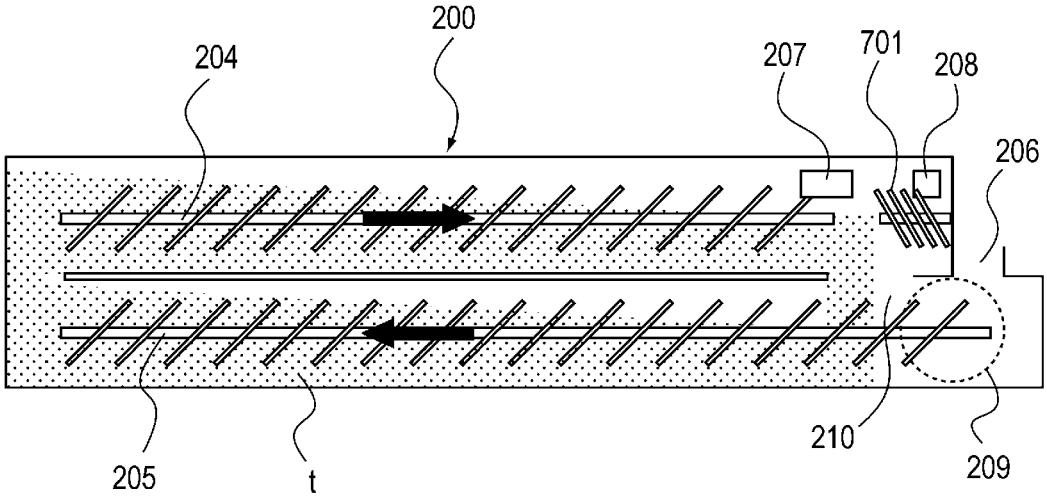
FIG. 4 is a sectional view in the longitudinal direction of a development apparatus according to a second embodiment.

Next, a development apparatus and an image forming apparatus of the second embodiment according to the present invention will be described with reference to the drawings. Here, description to be redundant to that of the first embodiment is skipped as providing the same reference numeral thereto. FIG. 4 is a sectional view in the longitudinal direction of the development apparatus 102 according to the present embodiment.

As illustrated in FIG. 4, the development apparatus 102 of the present embodiment includes a developer returning screw (i.e., a developer return member) 701 as being disposed to the development apparatus 102 of the first embodiment. The developer returning screw 701 is disposed to a passage branched from the developer circulation passage to the ventilation hole 208 and is rotated to return the developer toward the developer circulation passage. Accordingly, the developer is prevented from overflowing through the ventilation hole 208.

With the above structure, for example, even when the developer reaches the ventilation hole 208 side without being passed from the opening portion 210 to the screw 205 as being caused by developer flowability variation corresponding to variation of ambient temperature and humidity, the developer is returned to the opening portion 210 side again owing to the action of the developer returning screw 701 to get back to the developer circulation passage.

In the following, the embodiment of the present invention will be described in detail with reference to the drawings. The present invention can be actualized in another embodiment in which a part or all of the structure of the embodiment is replaced with an alternative structure as long as an air passage to inflow air to a replenishment passage having a replenishing screw is provided.

Accordingly, not limited to a vertical agitation type in which a development room and an agitation room are vertically arranged, the present invention can be actualized in a development apparatus in which a development room and an agitation room are arranged horizontally or obliquely. Further, not limited to a development apparatus having a single developer bearing member, the present invention can be actualized in a development apparatus having two or three developer bearing members.

Further, as long as for an image forming apparatus utilizing two-component developer, the present invention can be actualized regardless of a tandem type/a single drum type, an intermediate transfer type/a recording material conveying type/a direct transfer type, and a mono-color type/a full-color type. Although description of the present embodiment will be performed only on main portions relating to forming/transferring of a toner image, the present invention can be actualized for a variety of uses such as printers, various printing machines, copying machines, facsimiles, and combined machines as additionally providing necessary devices, equipment, and chassis.

<Image Forming Apparatus>

Figure 6:
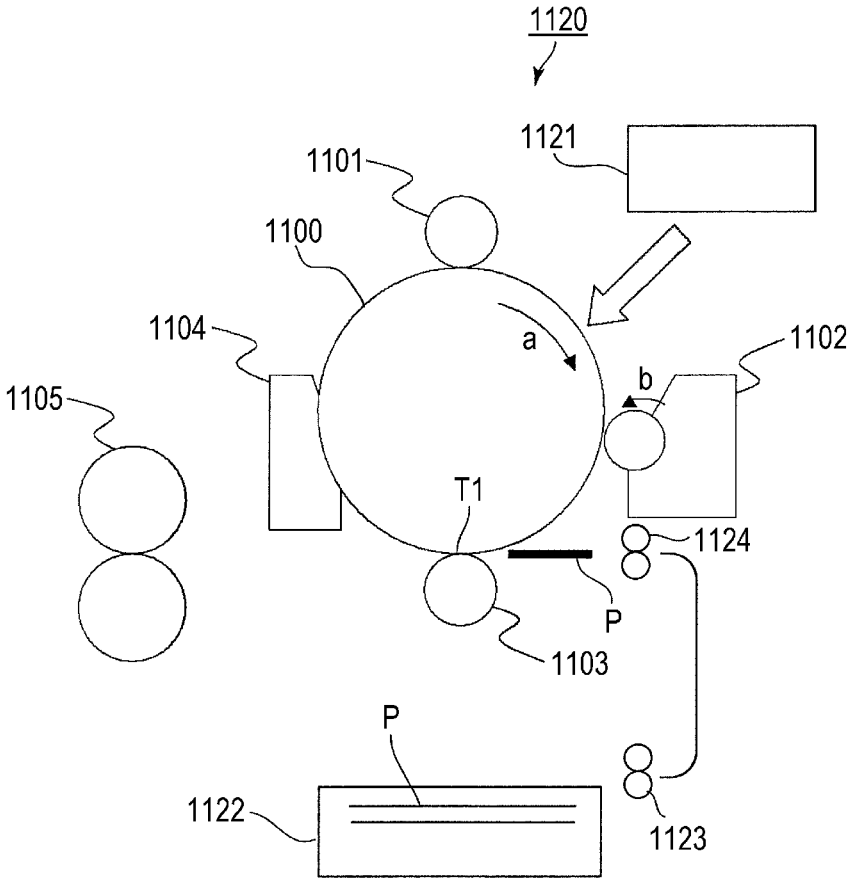
FIG. 6 is an explanatory view of a structure of an image forming apparatus.

FIG. 6 is an explanatory view of a structure of an image forming apparatus. As illustrated in FIG. 6, an image forming apparatus 1120 includes a charging roller 1101, an exposure apparatus 1121, a development apparatus 1102, a transfer roller 1103, and a drum cleaning apparatus 1104 around a photosensitive drum 1100.

The photosensitive drum 1100 is structured to form a photosensitive layer of which charging polarity is negative on a base body of an aluminum cylinder and is rotated in the direction of arrow a at a predetermined process speed. The charging roller 1101 charges the surface of the photosensitive drum 1100 evenly at negative-polarity dark potential VD as applying vibrating voltage obtained by superimposing alternate-current voltage to direct-current voltage.

The exposure apparatus 1121 writes an electrostatic image of an image on the surface of the photosensitive drum 1100 as scanning with a rotation mirror laser beams obtained by ON-OFF modulating image-expanded scanning line image data. When the surface potential of the photosensitive drum 1100 which is charged to the dark potential VD is decreased to bright potential VL as receiving the exposure, toner negatively charged in polarity can be stuck thereto.

As described later, the development apparatus 1102 forms a toner image by reversely developing the electrostatic image formed on the photosensitive drum 1100. The transfer roller 1103 constitutes a transfer portion T1 of the toner image against a recording material by being abutted to the photosensitive drum 1100. The toner image borne on the photosensitive drum 1100 is transferred to the recording material P by applying positive-polarity direct voltage to the transfer roller 1103.

The recording material P drawn from a recording material cassette 1122 is fed to a registration roller 1124 as being separated one by one at a separation roller 1123. The registration roller 1124 receives and holds the recording material P in a stopped state and feeds the recording material P to the transfer portion T1 in synchronized timing with the toner image of the photosensitive drum 1100.

The recording material P to which the toner image is transferred is fed to a fixing apparatus 1105 as being curvature-separated from the photosensitive drum 1100. After the toner image is fixed on the surface thereof as receiving heat and pressure, the recording material P is discharged to the outside of the apparatus. Transfer-remaining toner remaining on the photosensitive drum 1100 without being transferred is recovered to a drum cleaning apparatus 1104.

<Development Apparatus>

Figure 7:
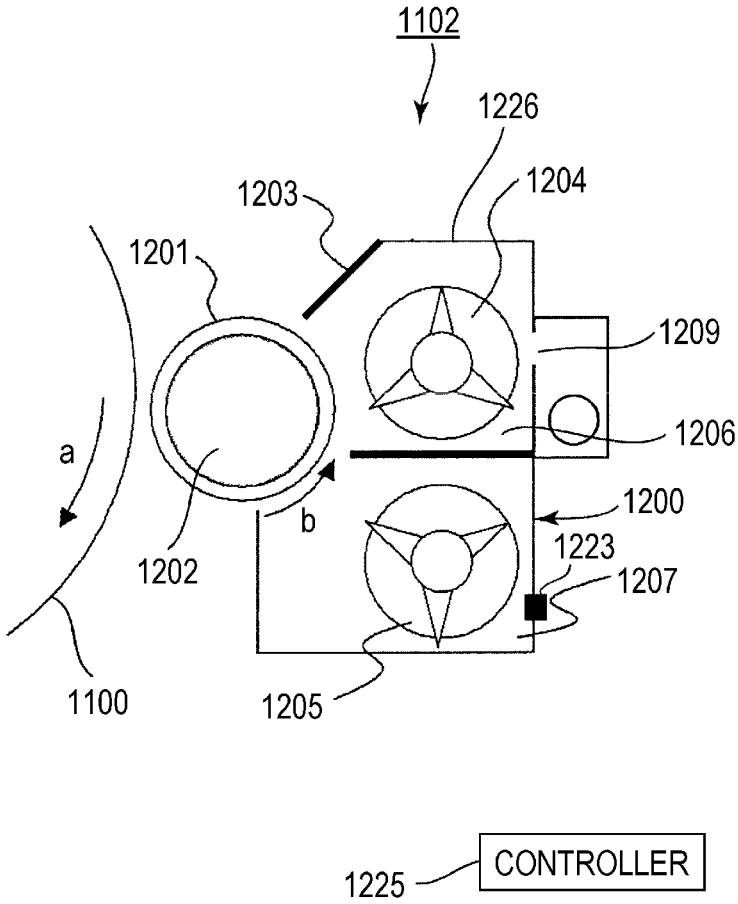
FIG. 7 is an explanatory view of a schematic structure of a development apparatus.
Figure 8:
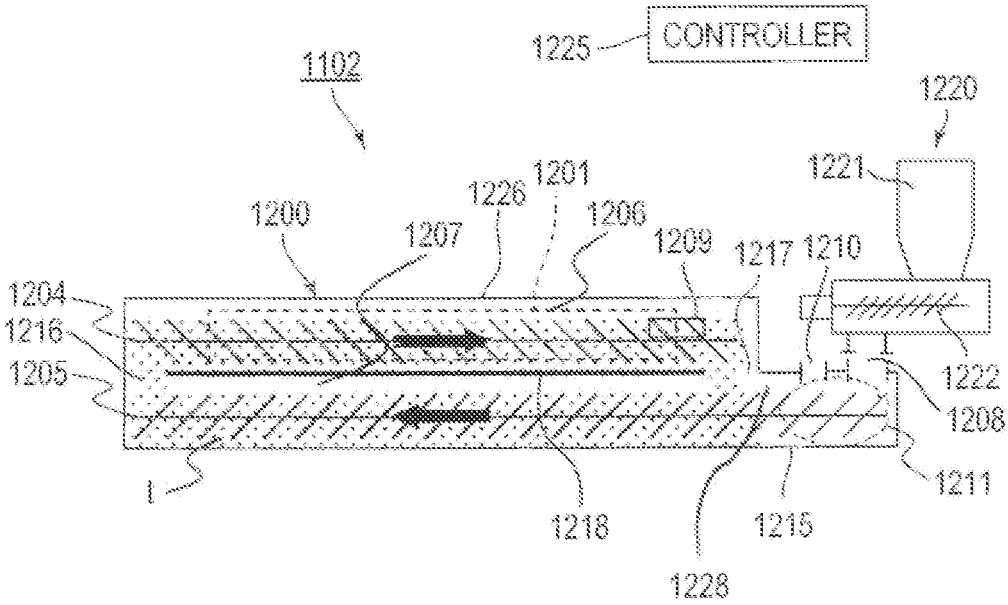
FIG. 8 is a schematic plane view of a development apparatus.

FIG. 7 is an explanatory view of a schematic structure of the development apparatus. FIG. 8 is a schematic plane view of the development apparatus.

As illustrated in FIG. 7, in the development apparatus 1102, two-component developer (i.e., developer) accommodated in a development container 1200 is conveyed as being mixed and agitated by a development screw 1204 and an agitation screw 1205. Then, toner and carrier of the developer are frictionally charged respectively to negative and positive. The development apparatus 1102 conveys frictionally-charged developer to a development area facing to the photosensitive drum 1100 by bearing at a rotating development sleeve 1201. When vibration voltage obtained by superimposing alternate-current voltage Vac to negative-polarity direct-current voltage Vdc is applied to the development sleeve 1201, only the toner out of the developer borne at the development sleeve 1201 is transferred to the electrostatic image (i.e., non-exposed part) of the photosensitive drum 1100. Accordingly, the electrostatic image is reversely developed to a toner image. The alternate-current voltage Vac of the vibration voltage being a rectangular wave has a frequency of 3 kHz and peak-to-peak voltage of 1.5 kV.

The development sleeve 1201 being an example of the developer bearing member is rotated as bearing the developer. The development screw 1204 conveys the developer along the development sleeve 1201 while supplying the developer to the development sleeve 1201. The agitation room 1207 is arranged below the development room 1206. The agitation screw 1205 is arranged as facing to the development sleeve 1201. The developer borne at the development sleeve 1201 in the development room 1206 is recovered from the development sleeve 1201 in the agitation room 1207.

The development sleeve 1201 is formed of non-magnetic material such as SUS and aluminum to be a thin cylindrical shape and is rotatably arranged to the development container 1200 at a position facing to the photosensitive drum 1100. The diameter of the development sleeve 1201 is 24.5 mm. A restricting blade 1203 faces to the development sleeve 1201 having a distance of 350 μm thereto. The restricting blade 1203 restricts layer thickness of the two-component developer to 350 μm by strickling surplus two-component developer borne to the development sleeve 1201 with magnetic flux of a magnetic roller 1202.

The non-rotatable magnetic roller 1202 to which a plurality of magnetic poles is arranged in the circumferential direction of the surface thereof is placed at the inside of the development sleeve 1201. The two-component developer is captured and borne on the surface of the development sleeve 1201 owing to the magnetic flux formed between magnetic poles of the magnetic roller 1202 and is frictionally slid on the photosensitive drum 1100 as forming a magnetic brush in response to the magnetic poles at the facing portion against the photosensitive drum 1100.

The developer in the development room 1206 is drawn from the development room 1206 to the development sleeve 1201 with magnetic force of the magnetic roller 1202 in the process of being conveyed from the back side to the front side of the drawing by the development screw 1204. The developer passed through the development area as being borne at the development sleeve 1201 is returned into the development container 1200, and then, is dropped into the agitation room 1207 while being removed from the surface of the development sleeve 1201 as receiving magnetic repulsive force of the magnetic roller 1202. The developer in the agitation room 1207 is conveyed from the front side to the back side in the drawing as being agitated by the agitation screw 1205 while being merged with the developer dropped from the development sleeve 1201.

As illustrated in FIG. 8, the agitation screw 1205 performs conveying as merging the developer recovered from the development sleeve 1201 to the developer passed through a second opening portion 1217. The development room 1206 and the agitation room 1207 partitioned with a partition wall 1218 are communicated through a first opening portion 1216 at the upstream side and the second opening portion 1217 at the downstream side of the development room 1206 so as to form a developer circulation passage. The agitation screw 1205 placed in the agitation room 1207 performs circulating toward the development room 1206 through the first opening portion 1216 as recovering the developer from the development sleeve 1201 and conveying the developer along with the developer passed through the second opening portion 1217.

The agitation room 1207 is arranged below the development room 1206 and the agitation screw 1205 is arranged below the development screw 1204. The development screw 1204 is arranged approximately in parallel to the development room 1206 along the axial direction of the development sleeve 1201 so as to convey the developer in the development room 1206 in one direction along the axial direction. The agitation screw 1205 is arranged in the agitation room 1207 in parallel to the development screw 1204 so as to convey the developer in the agitation room 1207 in the opposite direction to the conveyance direction of the development screw 1204. The developer is circulated in the development container 1200 through the first opening portion 1216 and the second opening portion 1217 at both ends of the partition wall 1218 as being conveyed by the development screw 1204 and the agitation screw 1205.

Both of the development screw 1204 and the agitation screw 1205 are rotated at a rotational speed of 420 rpm. Spiral blades of the development screw 1204 and the agitation screw 1205 have a spiral structure having the screw axis as the center at a pitch of 30 mm and having spiral outer circumferential radius of 10 mm.

<Developer Replenishment Apparatus>

The two-component developer is obtained by mixing and dispersing toner, carrier and a small amount of additives. The toner includes colored resin particles which include bonding resin, colorant and other additives as needed and colored particles to which an additive such as colloidal-silica fine powders is added. The toner is made of polyester-based resin having a negative electrostatic property. It is preferable that the volume mean particle diameter is between 5 μm and 8 μm inclusive. Here, the volume mean particle diameter of the toner is 7 μm.

As the carrier, it is preferable to adopt metal such as superficially-oxidized or non-oxidized iron, nickel, cobalt, manganese, chrome and rare earthes, alloys thereof, ferrite oxide or the like, for example. The method of manufacturing the magnetic particles is not specifically limited. The volume mean particle diameter of the carrier is between 20 μm and 50 μm, and preferably between 30 μm and 40 μm.

Resistivity thereof is $10^5$ Ωm or larger, and preferably is $10^6$ Ωm or larger. The carrier used here has the volume mean particle diameter of 40 μm, the resistivity of $5\times10^5$ Ωm, and the magnetized amount of 0.31 $Wb/m^2$ under the magnetic field of 100 mT.

In the development apparatus 1102, only the toner in the developer is consumed as the toner being transferred from the development sleeve 1201 to the photosensitive drum 1100 according to development of electrostatic images. Since the toner is consumed according to image forming, the development apparatus 1102 is provided with a replenishing port 1208 to replenish developer for replenishment including toner so that the consumed toner is compensated. The replenishing port 1208 is to be placed at a position so that the replenished toner is not borne to the development sleeve 1201 without being frictionally charged owing to sufficient agitation. As the appropriate position thereof, the replenishing port 1208 is disposed at the downstream side of the development room 1206 or the upstream side of the agitation room 1207 (see FIG. 8).

In the development apparatus 1102, a developer replenishment apparatus 1220 is connected to the replenishing port 1208 of a replenishment passage 1215 and the toner consumed in the development process is compensated from the developer replenishment apparatus 1220. A controller 1225 detects the mean permeability of the developer with a permeability sensor 1223 (see FIG. 7) which is disposed in the development container 1200, and then, calculates the weight ratio of the toner in the developer from the mean permeability. Then, when the weight ratio is below 8%, replenishment of the developer is performed by controlling a slicing screw 1222. The developer for replenishment includes 90% of the toner and 10% of the carrier in weight ratio. The developer for replenishment is dropped from the replenishing port 1208 to the replenishment passage 1215 as being sliced from the bottom of the hopper 1221 of the developer replenishment apparatus 1220 by the slicing screw 1222. The developer for replenishment in the hopper 1221 is conveyed to the replenishing port 1208 with rotation of the slicing screw 1222.

One end of the replenishment passage 1215 is communicated with the developer circulation passage and the developer replenishment apparatus 1220 is connected to the other end thereof. A replenisher conveying portion 1211 being an example of the replenishing screw is disposed to the replenishment passage 1215 and conveys and merges the developer replenished from the developer replenishment apparatus 1220 with the developer in the circulation passage. The developer to be replenished from the replenishing port 1208 is conveyed before being merged with the developer circulation passage in the development apparatus 1102 by the replenisher conveying portion 1211 which is disposed to the outside of the circulation passage. The replenisher conveying portion 1211 is a spiral blade disposed to convey only the developer for replenishment to which the developer circulating in the development apparatus 1102 is not mixed yet. The replenisher conveying portion 1211 is formed as a part of the agitation screw 1205 and conveys and merges the replenisher replenished from the replenishing port 1208 with the circulation passage of the circulating developer in the development container 1200.

Since the developer for replenishment includes the carrier at 10% in weight ratio, the developer circulating in the development container 1200 is gradually increased when replenishment from the developer replenishment apparatus 1220 is continued. The circulating developer exceeding a predetermined amount is collected as overflowing from the development container 1200 through a discharge port 1209 for overflowing disposed at the downstream side of the development room 1206.

<Vertical Agitation Type Development Apparatus>

In addition to advancing of miniaturization of an apparatus body to achieve space-saving, improving image quality is strongly desired for the image forming apparatus 1120. Accordingly, the development apparatus 1102 adopts a vertical agitation type in which the development container 1200 is partitioned into upper and lower sections by the partition wall 1218 and the development room 1206 having the development screw 1204 and the agitation room 1207 having the agitation screw 1205 are vertically arranged. With the vertical agitation type development apparatus 1102, since the development room 1206 and the agitation room 1207 are arranged in the vertical direction, occupying space in the horizontal direction can be small. Since the image forming apparatus 1120 is provided with a single image forming portion having the photosensitive drum 1100, the effect of space-saving is limited. However, in a case of a color image forming apparatus of a tandem type having a plurality of image forming portions mounted in parallel in the horizontal direction, it is possible to achieve miniaturization as remarkably reducing occupying space in the horizontal direction.

In the vertical agitation type development apparatus 1102, the remaining developer without being used for development at the development area after being borne at the development sleeve 1201 and being provided to the development area for development is recovered to the agitation room 1207 side according to rotation of the development sleeve 1201. Accordingly, only the developer which is sufficiently agitated in the agitation room 1207 exists continuously in the development room 1206, so that the developer having even toner density and a stable charge amount is supplied to the development sleeve 1201. Therefore, compared to a conventional development apparatus of a lateral agitation type, unevenness of imaging and concentration in the main scanning direction caused by insufficient agitation of the developer is reduced and even images can be output with high repeatability.

Here, in the development apparatus 1102 of a vertical agitation type, the developer continues to outflow to the agitation room 1207 as being borne at the development sleeve 1201 during the process of being agitated and conveyed in the development room 1206. Accordingly, the amount of the developer circulating in the development room 1206 is decreased with progression in the development room 1206. The developer passed from the agitation room 1207 to the development room 1206 does not entirely reach the downstream end of the development screw 1204 in the development room 1206. Some of the developer is supplied to the development sleeve 1201 and is recovered to the agitation room 1207 after passing through the development area of the photosensitive drum 1100. Passing of the developer from the development screw 1204 to the development sleeve 1201 is performed approximately at the entire area in the longitudinal direction of the development sleeve 1201.

Accordingly, the amount of the developer conveyed in the development room 1206 by the development screw 1204 is gradually decreased with progression from the upstream side to the downstream side. Therefore, compared to a conventional development apparatus of a lateral agitation type, the development flow is more likely to be influenced by disturbance as a result of less amount of the developer circulating at the downstream side of the development room 1206.

In particular, when developer flowability is decreased, the circulation speed of the developer is decreased while the outflow speed thereof from the development room 1206 to the agitation room 1207 via the development sleeve 1201 is constant. Therefore, the developer amount at the downstream side of the development room 1206 is further decreased. As a result, developer unbalance is formed in the longitudinal direction of the development room 1206. When the developer amount at the downstream side of the development room 1206 becomes lower than a predetermined level, the supplying state of the developer to the development sleeve 1201 becomes unstable. A coating state of the developer varies with unevenness. As a result of the unevenness, concentration of a toner image to be developed becomes unstable with progression toward the downstream side of the development sleeve 1201.

At the upstream side having a large amount of the developer, the developer supply amount to the development sleeve 1201 is stable and concentration of a toner image is kept constant. At the downstream side having a small amount of the developer, unevenness in concentration is more likely to occur at a toner image owing to shortage of the developer supply amount to the development sleeve 1201.

Here, when the total developer amount in the development container 1200 is increased, the developer supply amount to the development sleeve 1201 at the downstream side of the development room 1206 becomes stable. At the downstream side of the agitation room 1207, the developer is drawn to the development room 1206 as being pushed up from the lower to the upper owing to pressure of the developer accumulated at the end part of the agitation room 1207. When the total developer amount in the development container 1200 is increased, the pressure of the developer stemmed at the downstream side of the agitation room 1207 becomes excessively high. Then, there occurs a problem of output image contamination due to leakage of the developer from the development container 1200 to the outside through a peripheral gap of the development sleeve 1201. Thus, the problem cannot be solved only by simply increasing the developer amount in the development container 1200.

Japanese Patent Laid-open No. 11-84874 proposes a solution for the above problem to ease unevenness of the developer in the development room by varying developer conveying force of the development screw according to sections. However, it was proved by experiment that the problem of amount shortage of the developer circulating at the downstream side of the development room is not sufficiently solved. This is because there are other causes for shortage of the amount of the developer circulating at the downstream side of the development room. There arises a case that developer unevenness in the development room 1206 becomes salient when bulk density and flow characteristics of the developer are varied owing to variation of ambient temperature and humidity, toner concentration variation, developer change, and developer aging deterioration. Further, it is confirmed that developer unevenness in the development room 1206 becomes salient owing to variation of air pressure and airflow in the development apparatus 1102.

In view of the above, following examples keep the amount of the developer flowing at the downstream side of the development room 1206 at a constant level or more by easing airtightness at the vicinity of the replenishing port 1208, so that developer supplying shortage to the development sleeve 1201 is solved.

Example 1

Figure 9:
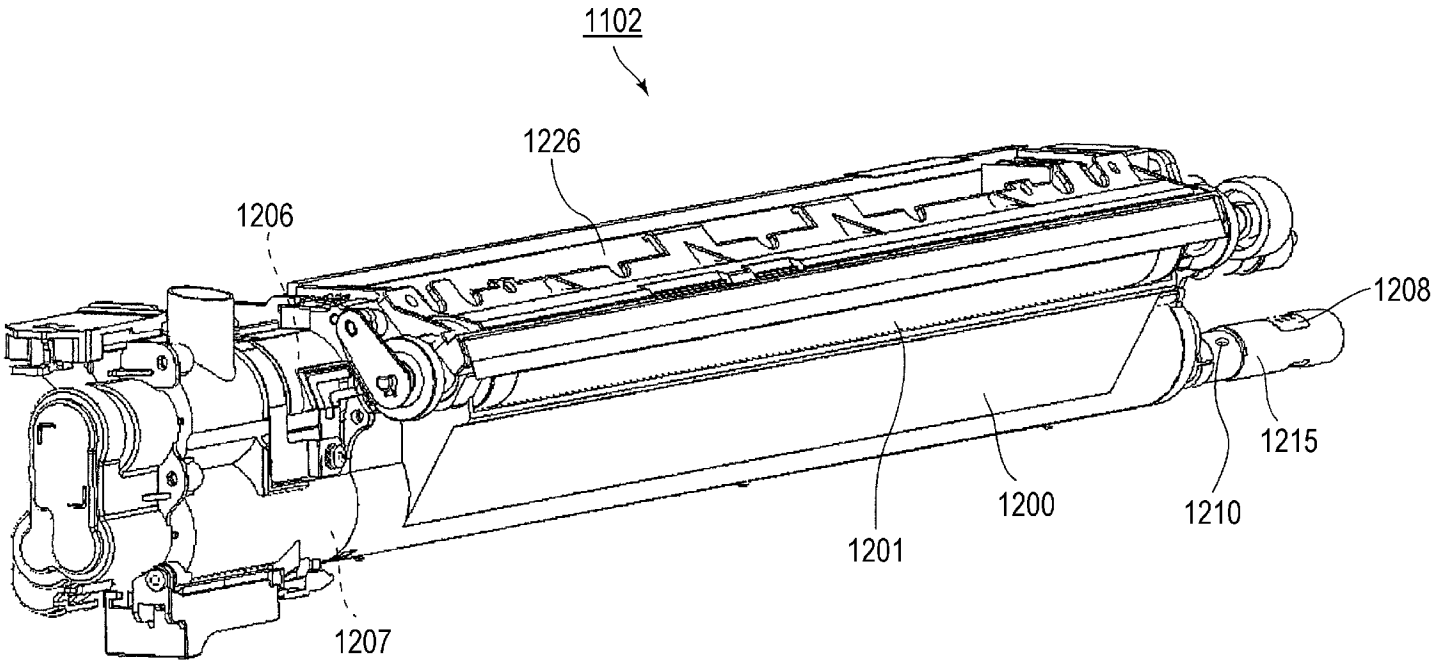
FIG. 9 is an explanatory view of an experiment utilizing a development apparatus of example 1.
Figure 10:
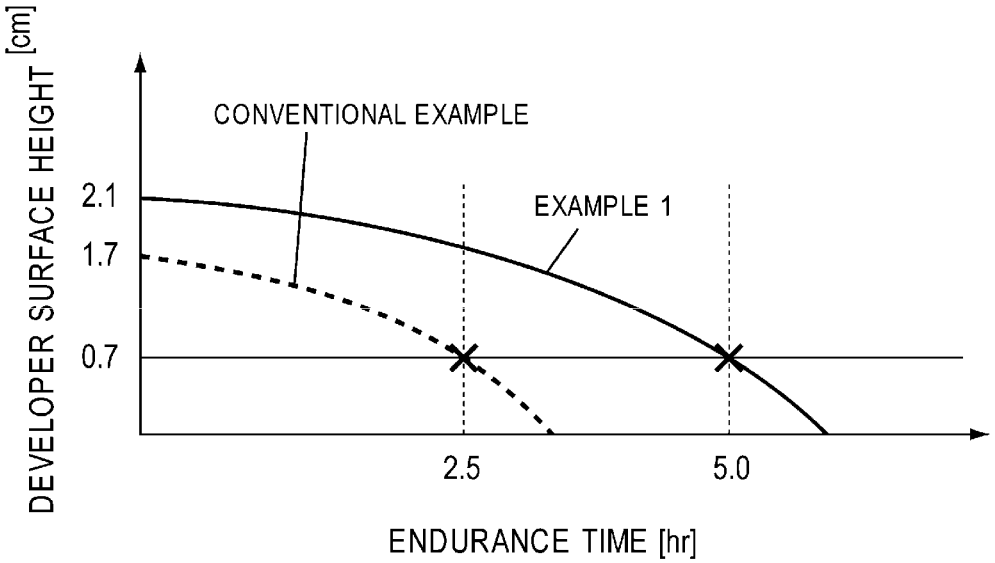
FIG. 10 is a graph indicating an effect of a ventilation hole of example 1.

FIG. 9 is an explanatory view of an experiment utilizing a development apparatus of example 1. FIG. 10 is an explanatory graph for an effect of a ventilation hole of example 1.

As illustrated in FIG. 8, in example 1, the replenishment passage 1215 is arranged to be communicated with the upstream side of the agitation room 1207 and is provided with the replenisher conveying portion 1211 which utilizes a spiral blade having the same pitch and the same diameter as those of the agitation screw 1205 as being coaxial thereto. The ventilation hole 1210 being an example of an air passage provides air inflow to the replenishment passage 1215. In addition to a connection part 1228 between the replenishment passage 1215 and the developer circulation passage, air can inflow to the replenishment passage 1215 through the ventilation hole 1210. The ventilation hole 1210 is arranged at the replenishment passage 1215 between a position to which the developer replenishment apparatus 1220 replenishes the developer to the replenisher conveying portion 1211 and a position at which the replenished developer merges with the developer in the circulation passage as being conveyed by the replenisher conveying portion 1211.

The ventilation hole 1210 is a circular hole of which diameter is 5 mm as being formed at a ceiling portion in the vicinity of the replenisher conveying portion 1211. The ventilation hole 1210 has a function to prevent decrease of the circulation amount of the developer at the downstream side of the development room 1206 by relieving negative pressure at the vicinity of the replenishing port 1208.

As illustrated in FIG. 9 with reference to FIG. 7, the development apparatus 1102 was separately took out and developer flow in the development room 1206 was set to be visible from the outside by replacing a ceiling portion 1226 of the development container 1200 with a clear resin plate. A corresponding amount of toner was electrostatically removed from the development sleeve 1201 while developer replenishment was performed as assuming normal image forming with connecting the developer replenishment apparatus 1220 (not illustrated) to the replenishing port 1208 of the replenishment passage 1215. In this state, the development apparatus 1102 was operated for testing and temporal change of developer flow in the development room 1206 was observed from the outside.

In this case, decrease in developer flowability was not observed. The developer surface height at the downstream side of the development room 1206 stayed almost at the same from the test starting even though continuous operation was performed for 2.5 hours. In addition, poor supplying of the developer to the development sleeve 1201 did not occur as well.

Next, temporal change of developer flow in the development room 1206 was observed from the outside with intentional progression of developer deterioration by performing continuous operation only of the development apparatus 1102 without performing toner removing from the development sleeve 1201 and developer replenishment by the developer replenishment apparatus 1220.

In this case, decrease in developer flowability was observed according to progression of developer deterioration. The developer surface height at the downstream side of the development room 1206 (see FIG. 7) became lower than 7 mm in 2.5 hours from initial height of 20 mm. At the same time, developer bearing unevenness was observed at the development sleeve 1201.

Next, a similar experiment was performed after replacing the developer as forming the ventilation hole (i.e., a simple penetrating hole) 1210 of which diameter is 5 mm at the replenishment passage 1215. Then, temporal change of developer flow in the development room 1206 was observed from the outside by performing continuous operation only of the development apparatus 1102 without performing toner removing from the development sleeve 1201 and developer replenishment by the developer replenishment apparatus 1220.

In this case, decrease in developer flowability was observed according to progression of developer deterioration. However, the developer surface height at the downstream side of the development room 1206 was 15 mm or higher in 2.5 hours and developer bearing unevenness was not observed at the development sleeve 1201 at that time. Further, with observation utilizing smoke, it was confirmed that air was drawn through the ventilation hole 1210 during operation of the development apparatus.

According to the above preliminary experiment, it is confirmed that the ventilation hole 1210 has an effect to retard poor developer supplying to the development sleeve 1201 as retarding decrease of the developer amount at the downstream side of the development room 1206 corresponding to developer deterioration by causing air inflow. Further, it is confirmed that poor developer supplying to the development sleeve 1201 depends on the amount of the developer existing in the development room 1206 and that poor developer supplying to the development sleeve 1201 occurs in a section having a small amount of the developer.

Specifically, there is a threshold value of the developer surface height for occurrence of poor developer supplying to the development sleeve 1201. Here, developer bearing unevenness occurs at a section in which the surface height is below the threshold value. The developer bearing unevenness at the development sleeve 1201 does not occur during a term having satisfactory developer flowability at an initial state of the continuous operation. However, when the developer flowability is decreased with continuous operation having small toner consumption, poor developer supplying to the development sleeve 1201 from the downstream side of the development room 1206 starts to occur. Here, although decrease of the developer flowability cannot be suppressed, forming the ventilation hole 1210 at the replenishment passage 1215 has an effect to suppress occurrence of developer bearing unevenness by retarding developer surface lowering at the downstream side of the development room 1206 even when the flowability is decreased.

Based on the above, experiment to quantify a developer supplying property to the development sleeve 1201 at the downstream side of the development room 1206 was performed. As indicated in FIG. 10, the developer supplying property to the development sleeve 1201 is defined by a continuous operation time until the developer surface height falls below the threshold value of 7 mm as the horizontal axis denoting an endurance time and the vertical axis denoting the developer surface height in the development room 1206 from the partition wall 1218. The developer surface height was measured at an end part of a possible development area of the development sleeve 1201 at the downstream side of the development room 1206. The endurance time of the horizontal axis denotes a time in which only the development apparatus 1102 is continuously operated without performing development and replenishment.

Here, comparison was performed between example 1 having the ventilation hole 1210 opened and a conventional example having the ventilation hole 1210 plugged in a state that the replenishing port 1208 of the development apparatus 1102 is completely plugged. The conditions of the both were equalized as filling 300 g of new developer into the development apparatus 1102 at the time of starting the continuous operation.

As indicated in FIG. 10, with the conventional example having the ventilation hole 1210 plugged, poor developer supplying was observed on the development sleeve 1201 when 2.5 hours of the continuous operation time passed. Meanwhile, with example 1 having the ventilation hole 1201 opened, poor developer supplying was observed on the development sleeve 1210 when 5.0 hours being twice of the conventional example passed.

In this manner, it was confirmed that the developer supplying property to the development sleeve 1201 was improved to be doubled by opening the ventilation hole 1210. Further, in example 1, the developer surface height at the downstream side of the development room 1206 was higher than that of the conventional example approximately by 4 mm at 2.5 hours after starting the continuous operation with the same developer amount of 300 g.

In the development apparatus 1102, the threshold value of the developer surface height at the downstream side of the development room 1206 was 7 mm. In the case that the ventilation hole 1210 was plugged, the developer overflows from the development container 1200 earlier than 2.5 hours when the filled developer amount was more than 300 g.

As described above, the developer supplying property to the development sleeve 1201 is remarkably improved in example 1 by forming the ventilation hole 1210 at the replenishment passage 1215. As long as being capable of taking sufficient air, the ventilation hole 1210 provides the effect with any shape in a manner not to impair other functions without any limitation of size and shape. In example 1, a circular hole of which diameter is 5 mm was formed.

In example 1, the developer is stably supplied to the development sleeve 1201 for a long time being twice compared to a conventional development apparatus without having the ventilation hole 1210 by forming the ventilation hole 1210 at the replenishment passage 1215. Accordingly, example 1 enables to prevent occurrence of concentration unevenness of an image caused by developer supplying unevenness to the development sleeve 1201.

In example 1, the developer supplying amount to the development sleeve 1201 at the downstream side of the development room 1206 is stabilized as relieving negative pressure at the vicinity of the replenishing port 1208 by forming the ventilation hole 1210 at the replenishment passage 1215. As a result, it is possible to prevent decrease in image quality due to developer supplying shortage to the development sleeve 1201.

Further, regarding toner replenishing accuracy through the replenishing port 1208, there has been a problem with a conventional development apparatus without having the ventilation hole 1210 in supplying toner by a stable amount to be essentially replenished owing to irregular drawing of toner in the hopper 1221 with negative pressure.

On the contrary, in example 1, the phenomenon to repeat excessive replenishment and replenishment shortage of toner owing to drawing caused by negative pressure was resolved by forming the ventilation hole 1210 at the replenishment passage 1215.

As described above, regarding example 1, the experiment to observe developer flow in the developer circulation passage is performed with the vertical agitation type development apparatus in which the replenishment passage is arranged at the upstream side of the agitation room. As a result, large turbulence of the flow of the developer circulating in the circulation passage was observed at each time of developer replenishment. The experiment provided a result that the developer flow state was stabilized at the time of developer replenishment when an opening was formed at the replenishment passage between a position to which the developer replenishment apparatus replenishes the developer and a position to which the replenished developer was merged to the developer in the circulation passage. It was confirmed that air inflow through the opening according to stabilization of the developer flow. Accordingly, it was experimentally proved that forming an air passage to cause air inflow at the replenishment passage relieved "a phenomenon that flow of the developer circulating in the circulation passage is disturbed each time when the developer is replenished through the replenishment passage in which the replenishing screw is arranged".

<Consideration of Action of Ventilation Hole>

Figure 11:
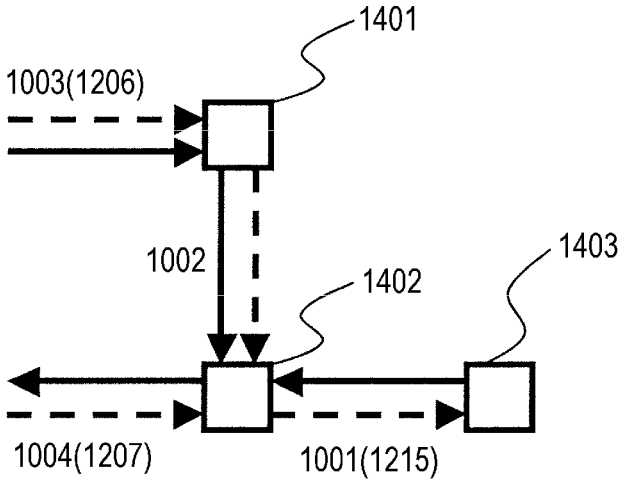
FIG. 11 is an explanatory diagram of air flow in a case that developer is replenished at the upstream side of an agitation room.
Figure 12:
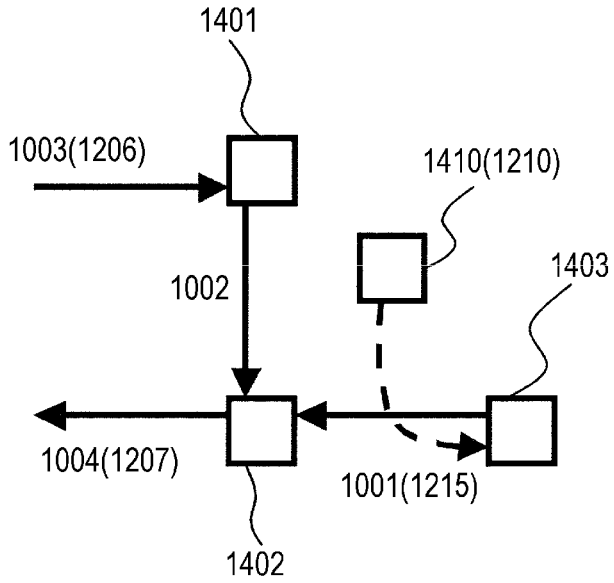
FIG. 12 is an explanatory diagram of air flow in a case that a ventilation hole is arranged at a replenishment passage.
Figure 13:
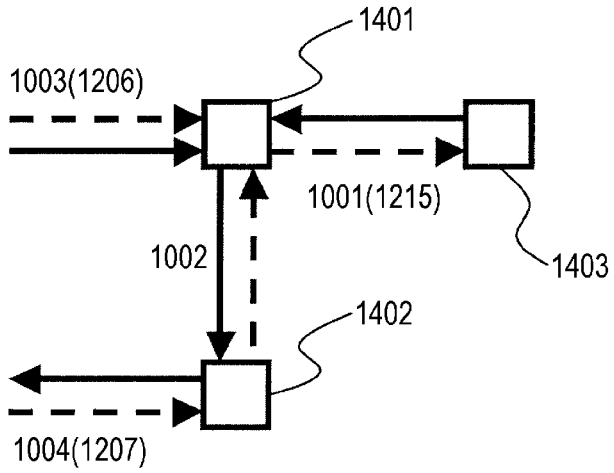
FIG. 13 is an explanatory diagram of air flow in a case that developer is replenished at the downstream side of a development room.

FIG. 11 is an explanatory diagram of air flow in a case that developer is replenished at the upstream side of the agitation room. FIG. 12 is an explanatory diagram of air flow in a case that the ventilation hole is formed at the replenishment passage. FIG. 13 is an explanatory diagram of air flow in a case that developer is replenished at the downstream side of the development room.

In a case that pressure at a regional part in the development apparatus becomes negative compared to surroundings for some reason during operation of the development apparatus, it is considered that airflow is generated as air being drawn to the negative-pressure part to influence the flow of circulating developer. It is considered that the airflow due to the negative pressure is a cause to disturb normal circulation flow of the developer in the development container to be controlled by the development screw and the agitation screw. It is considered that developer unevenness becomes large in the longitudinal direction of the development room when the developer flow is disturbed.

As illustrated in FIG. 8, in the development apparatus 1102, airtightness at the vicinity of the replenishing port 1208 is appropriately high to prevent splashing and leakage of toner. Since airtightness at the connection part between the replenishing port 1208 and the developer replenishment apparatus 1220 connected thereto is appropriately maintained, the replenishing port 1208 is considered to be in a state of being hermetically-closed. Accordingly, in the development apparatus 1102, there is a tendency that pressure at the vicinity of the replenishing port 1208 becomes negative. It is considered that pressure at the vicinity of the replenishing port 1208 becomes negative as a result of that air at the vicinity of the replenishing port 1208 is sucked by the replenisher conveying portion 1211 according to a similar principle to a vacuum pump. At that time, since the replenishing port 1208 is located at the most upstream side in the agitation room 1207, the developer at the upstream side of the agitation room 1207 and at the downstream side of the development room 1206 is drawn to the vicinity of the replenishing port 1208 along airflow caused by negative pressure.

First, it is assumed of a case that the ventilation hole 1210 does not exist. During operation of the agitation screw 1205, negative pressure is caused with suction of air around the replenisher conveying portion 1211 toward the agitation room 1207 by the replenisher conveying portion 1211 which has a function to convey the developer for replenishment as being connected to the agitation screw 1205. Then, to compensate air around the replenisher conveying portion 1211 having negative pressure, air at the downstream side of the development room 1206 is sucked toward the replenisher conveying portion 1211. Concurrently, the developer at the downstream side of the development room 1206 is drawn to the replenisher conveying portion 1211 along therewith.

The degree of developer drawing depends on air pressure difference between the vicinity of the replenisher conveying portion 1211 and the vicinity of the downstream side of the development room 1206. Then, the air pressure difference depends on airtightness at the vicinity of the hermetically-closed replenishing port 1208. Further, since the replenisher conveying portion 1211 which causes the negative pressure is located at the most upstream side in the agitation room 1207, the developer amount at the upstream side of the agitation room 1207 is increased and the developer amount at the downstream side of the development room 1206 is concurrently decreased compared to a case that the negative pressure is not generated. Therefore, it is considered that the negative pressure occurring at the vicinity of the replenishing port 1208 worsens the problem of less developer amount at the downstream side in the longitudinal direction of the development room 1206.

It can be considered to increase the total developer amount circulating in the development apparatus 1102 for increasing the developer amount at the downstream side of the development room 1206. However, there is an upper limit value of the developer amount acceptable for the development container 1200. When exceeding the upper limit value, there arises another problem that the developer overflows outside the container through a gap in the development apparatus 1102 (in particular, through the developer drawing portion from the agitation room to the development room in most cases). Further, when developer flowability is decreased according to accumulative usage time, developer unevenness becomes salient in the longitudinal direction of the development room 1206 and the upper limit value of the developer amount is decreased concurrently. When decrease in developer flowability progresses, there concurrently occurs poor developer supplying to the development sleeve 1201 at the downstream side of the development room 1206 and developer overflowing at the upstream side of the development room 1206 in course of time.

Next, it is assumed of a case that the ventilation hole 1210 exists. In this case, since airtightness around the replenisher conveying portion 1211 is lost, the negative pressure is remarkably relieved. This is because air is positively supplied from the outside of the development container 1200 through the ventilation hole 1210. As a result, the air and developer at the downstream side of the development room 1206 are prevented from being drawn, so that the developer amount existing at the downstream side of the development room 1206 is increased by the amount to have been drawn. Accordingly, the developer supplying property to the development sleeve 1201 is drastically improved, so that preferable developer balance satisfying both of developer supplying and developer overflow preventing can be maintained for a long time.

As schematically illustrating the downstream side of the development room and the upstream side of the agitation room of the development apparatus as in FIG. 11, the developer is moved from a developer passing start point 1401 at the development room side toward a developer passing completion point 1402 at the agitation room side as indicated by a solid line. In accordance therewith, airflow is generated from the developer passing start point 1401 toward the developer passing completion point 1402 as indicated by a dotted line. In a case without the ventilation hole, an end part 1403 of the replenishment passage is hermitically-closed. Accordingly, negative pressure is generated between the developer passing completion point 1402 and the end part 1403 of the replenishment passage (here, the section thereof is called section 1001) and airflow is generated from the developer passing completion point 1402 toward the end part 1403 of the replenishment passage.

Similarly, there occurs airflow from the downstream side of the agitation room toward the developer passing completion point 1402 (here, the section thereof is called section 1004) and airflow from the developer passing start point 1401 toward the developer passing completion point 1402 (here, the section thereof is called section 1002). At the same time, there occurs airflow from the upstream side of the development room toward the developer passing start point 1401 (here, the section thereof is called section 1003). Here, considering developer conveyance direction, an airflow direction and a developer conveyance direction are aligned to the same direction respectively in section 1002 and section 1003. As a result, it is considered that the problem that the developer amount is decreased at the downstream side of the development room is caused owing to accelerated developer flow in section 1002 and section 1003 and easier developer accumulation at the vicinity of the developer passing completion point 1402.

Here, as illustrated in FIG. 12, airflow is varied by arranging an air passage 1410 somewhere in section 1001 of a development apparatus which actualizes the diagram of FIG. 11. Then, airflow due to the negative pressure in section 1002 and section 1103 is suppressed and normal developer circulation is established. Accordingly, the phenomenon of unstable developer supplying to the development sleeve with decreasing of the developer amount at the downstream side of the development room 1206 is less likely to occur. The effect of arranging the air passage 1410 somewhere in section 1001 is particularly salient with a vertical agitation type development apparatus in which developer continuously flows from the development room 1206 to the agitation room 1207 through the development sleeve.

Here, as a lateral agitation type development apparatus, a development apparatus in which developer is returned to a development room after being supplied to a development sleeve from the development room has been in practical use. In this case, since developer flowing from the development room to an agitation room through the development sleeve does not exist, the developer amount in the development room is continuously kept approximately at constant and the developer amount is less likely to be decreased at the downstream side of the development room. As described for example 1, with a development apparatus in which developer continuously flows from a development room to an agitation room through a development sleeve, developer unevenness in the longitudinal direction of the development room tends to become large. Therefore, not necessarily being the vertical agitation type, the effect of forming a ventilation hole at a replenishment passage is large with a development apparatus in which developer flows from a development room to an agitation room through a development sleeve and in which the developer amount at the downstream side of the development room tends to be decreased.

Further, as illustrated in FIG. 13, a development apparatus in which a replenishment passage having a hermetically-closed space and a conveying unit of developer are arranged at the most downstream side of the development room not at the most upstream side of the agitation room has been in practical use. In this case, since negative pressure is generated at the most downstream side of the development room, the airflow direction and the developer conveyance direction in section 1002 are reversed. Accordingly, since developer is more likely to be accumulated at the vicinity of the developer passing start point 1401, the problem that the developer amount is decreased at the downstream side of the development room is relieved. As described for example 1, with a development apparatus in which a replenishment passage having a hermetically-closed space and a developer conveying unit are arranged at the upstream side of an agitation room, developer unevenness in the longitudinal direction of the development room tends to become large. Therefore, the effect of forming a ventilation hole at a replenishment passage is large with a structure in which negative pressure is generated at the most upstream side of the agitation room.

It is considered that substance of the problem stays in that the replenishment passage 1215 is a hermetically-closed space and that negative pressure is generated by operation of the replenisher conveying portion 1211, as illustrated in FIG. 8. Accordingly, the structure that the replenishment passage 1215 is connected to and the replenishing port 1208 is formed at the most upstream side of the agitation room 1207 is not a necessary condition. However, in the vertical agitation type development apparatus 1102, since it is preferable that the replenishing port 1208 is arranged at the farthest point from the upstream side of the development sleeve 1201, the replenishing port 1208 tends to be disposed at the most upstream side of the agitation room 1207. Then, a hermetically-closed space is intentionally formed at the vicinity of the replenishing port 1208 to prevent toner splashing, negative pressure is naturally generated according to operation of the replenisher conveying portion 1211. That is, not being a necessary condition, being a vertical agitation type development apparatus is apt to be a sufficient condition for causing developer supplying shortage to the development sleeve 1201.

Example 2

As illustrated in FIG. 8, in the experiment with example 1, a state of toner splashing from the ventilation hole 1210 was not observed. During operation of the development apparatus 1102, the replenisher conveying portion 1211 generates negative pressure at the vicinity of the replenishing port 1208 of the replenishment passage 1215 as being rotated integrally with the agitation screw. Accordingly, air is continuously drawn from the outside through the ventilation hole 1210 to relieve the negative pressure. Since the developer for replenishment conveyed by the replenisher conveying portion 1211 receives push-back force into the replenishment passage 1215 due to gravity and air drawn from the outside being larger than splashing force from the ventilation hole 1210, toner is less likely to be splashed. However, there is a possibility of toner splashing when drawn airflow is weakened at the time of starting and stopping.

Therefore, in example 2, the ventilation hole 1210 is communicated with a space outside the replenishing port 1208 through a filter which blocks developer. Since the ventilation hole 1210 is formed for drawing air, the effect of example 1 is not disturbed even if a mesh or a filter is disposed to the ventilation hole 1210 to prevent splashing and overflowing of toner as long as air can be sufficiently drawn.

Example 3

Figure 14:
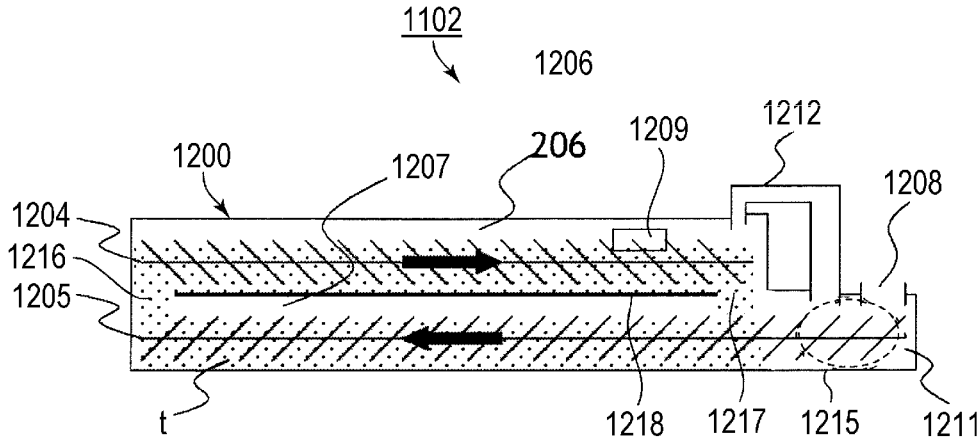
FIG. 14 is an explanatory view of a communication mechanism of a development apparatus of example 3.
Figure 15:
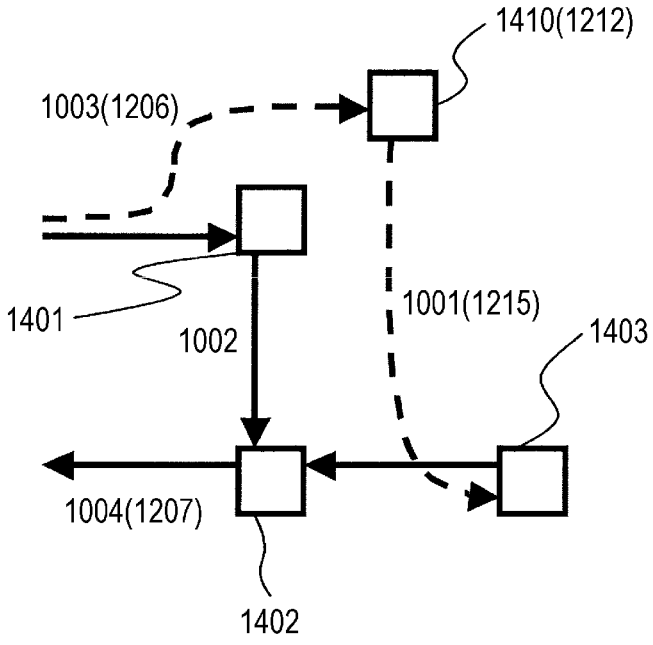
FIG. 15 is an explanatory diagram of air flow in a case that a ventilation hole is arranged at a replenishment passage.

FIG. 14 is an explanatory view of a communication mechanism in a development apparatus of example 3. FIG. 15 is an explanatory diagram of air flow in a case that a ventilation hole is disposed to a replenishment passage.

As illustrated in FIG. 14, a communication mechanism 1212 being an example of an air passage has one end thereof communicated with the replenishment passage 1215 and has the other end communicated with the development room 1206 at the upstream side of the second opening portion 1217. Since the rest of the structure is the same as example 1, duplicative description will not be repeated as providing the common reference numerals in FIGS. 8 and 12 to the common structure to example 1.

The replenishment passage 1215 having the replenisher conveying portion 1211 disposed and the downstream side of the development room 1206 are communicated by the communication mechanism 1212. Similarly to the ventilation hole 1210 (see FIG. 8) of example 1, the communication mechanism 1212 is provided between a ceiling part of the replenishment passage 1215 and a ceiling part of the development room 1206 to prevent developer drop due to gravity. The communication mechanism 1212 relieves air pressure difference between the both ends of the communication mechanism 1212 by providing communication between the downstream side of the development room 1206 and a negative pressure occurring position.

Example 3 has an advantage, which is not obtained with example 1, that the air passage is closed within the development container 1200 by drawing air for relieving the negative pressure at the replenishment passage 1215 from the inside of the same development container 1200 not from the outside. Therefore, there is no need to care for air blowing and toner splashing from the development container 1200.

The mechanism of occurring and relieving of the negative pressure is described with a diagram as illustrated in FIG. 15. Since one side of the air passage 1410 corresponding to the communication mechanism 1212 is located in section 1001 and the other side thereof is located at the upstream side of the developer passing start point 1401, airflow is generated as indicated by dotted lines. That is, it is considered that the phenomenon of developer to be drawn to the developer passing completion point 1402 can be suppressed with airflow changes caused by negative pressure in section 1002 and section 1004.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-13975, filed Jan. 26, 2011 and Japanese Patent Application No. 2011-153782, filed Jul. 12, 2011, which are hereby incorporated by reference herein in their entirety.

What is claimed is:

1. A development apparatus, comprising:

a developer bearing member which develops a latent image;

a first room which supplies a developer to the developer bearing member, disposed at a position facing the developer bearing member;

a second room which recovers the developer from the developer bearing member, disposed at a position facing the developer bearing member, wherein the second room is connected to the first room via open portions formed at both ends of the first room, with the first room and the second room forming a circulation passage for circulating the developer;

a partition wall partitioning the first room and the second room;

a first conveying member disposed in the first room and being rotatable to convey the developer in the first room;

a second conveying member disposed in the second room are being rotatable to convey the developer in the second room;

a replenishment conveying portion containing a replenishing screw disposed coaxially to the second conveying member and conveying the developer from outside of the circulation passage to the second room;

a replenishment passage which houses the replenishment conveying portion therein and replenishes the developer;

a discharge port disposed in the circulation passage and through which surplus developer is discharged;

a replenishing port through which the developer is replenished to the replenishment passage; and a ventilation port formed outside of the developer circulation passage.

2. The development apparatus according to claim 1, further comprising a connection passage which connects the replenishment passage and the circulation passage via the ventilation port.

3. The development apparatus according to claim 1, wherein the ventilation port is formed outside of the circulation passage at a downstream side of a conveyance direction of developer in the first room, and the first conveying member has a reverse conveying portion which is disposed at a position facing the ventilation port and returns the developer into the circulation passage.

4. The development apparatus according to claim 1, wherein the ventilation port is formed inside of the replenishment passage.

* * * * *